US007478539B2

(12) United States Patent
Shapiro et al.

(10) Patent No.: US 7,478,539 B2
(45) Date of Patent: Jan. 20, 2009

(54) TWO-STAGE LINEAR COMPRESSOR

(75) Inventors: Doron Shapiro, St. Louis, MO (US); Clay Rohrer, Belle, MO (US)

(73) Assignee: Hussmann Corporation, Bridgeton, MO (US)

( * ) Notice: Subject to any disclaimer, the term of this patent is extended or adjusted under 35 U.S.C. 154(b) by 482 days.

(21) Appl. No.: 11/166,533

(22) Filed: Jun. 24, 2005

(65) Prior Publication Data

US 2006/0288719 A1 Dec. 28, 2006

(51) Int. Cl.
*F25B 1/10* (2006.01)
*F25B 43/00* (2006.01)
*H02P 1/00* (2006.01)

(52) U.S. Cl. ..... 62/175; 62/228.3; 62/510; 62/513; 417/44.1; 417/417; 318/135

(58) Field of Classification Search ..... 62/175, 62/510, 228.3, 113, 513; 417/415, 417, 44.1, 417/410.1; 318/135
See application file for complete search history.

(56) References Cited

U.S. PATENT DOCUMENTS 3,229,475 A 1/1966 Balk et al.
3,937,600 A 2/1976 White
4,580,414 A 4/1986 Engelhard
4,594,858 A 6/1986 Shaw
4,706,470 A 11/1987 Akazawa et al.
4,750,871 A 6/1988 Curwen
4,787,211 A 11/1988 Shaw
5,095,712 A 3/1992 Narreau
5,600,961 A 2/1997 Whipple, III
5,775,117 A 7/1998 Shaw
5,779,455 A 7/1998 Steiger
5,809,792 A 9/1998 Song (Continued)

FOREIGN PATENT DOCUMENTS

DE 4127754 A1 2/1993

(Continued)

OTHER PUBLICATIONS

European Search Report dated Aug. 21, 2007.

(Continued)

*Primary Examiner*—Marc E Norman
(74) *Attorney, Agent, or Firm*—Michael Best & Friedrich LLP

(57) ABSTRACT

A refrigeration system includes a two-stage linear compressor having a first piston disposed in a first cylinder and a second piston disposed in a second cylinder. The linear compressor is operable in an economizer cycle wherein the first piston operates as a first stage of the economizer cycle and the second piston operates as a second stage of the economizer cycle. A controller is coupled to the linear compressor to control a volume flow ratio of the linear compressor. The controller stores a plurality of coefficients of performance for a range of particular operating conditions of the linear compressor and each coefficient of performance corresponds to a desired volume flow ratio and a desired secondary evaporating temperature. Based upon measured operating conditions of the linear compressor, the controller determines a highest coefficient of performance from the plurality of coefficients of performance and varies operation of at least one of the first and second pistons to achieve the desired volume flow ratio.

29 Claims, 4 Drawing Sheets

U.S. PATENT DOCUMENTS

| | | | | |
|---|---|---|---|---|
| 5,947,693 | A | 9/1999 | Yang | |
| 5,980,211 | A | 11/1999 | Tojo et al. | |
| 6,082,132 | A | 7/2000 | Numoto et al. | |
| 6,084,320 | A | 7/2000 | Morita et al. | |
| 6,092,999 | A | 7/2000 | Lilie et al. | |
| 6,105,378 | A | 8/2000 | Shaw | |
| 6,231,310 | B1 | 5/2001 | Tojo et al. | |
| 6,276,148 | B1 | 8/2001 | Shaw | |
| 6,286,326 | B1 | 9/2001 | Kopko | |
| 6,425,255 | B1 | 7/2002 | Hoffman | |
| 6,437,524 | B1 | 8/2002 | Dimanstein | |
| 6,474,087 | B1 | 11/2002 | Lifson | |
| 6,527,519 | B2 | 3/2003 | Hwang et al. | |
| 6,554,577 | B2 | 4/2003 | Park et al. | |
| 6,619,052 | B1 | 9/2003 | Nash, Jr. | |
| 6,623,246 | B2 | 9/2003 | Hwang et al. | |
| 6,623,255 | B2 | 9/2003 | Joong et al. | |
| 6,641,377 | B2 | 11/2003 | Toyama et al. | |
| 6,663,351 | B2 | 12/2003 | Joo | |
| 6,820,434 | B1 | 11/2004 | Gutheim et al. | |
| 7,032,400 | B2 | 4/2006 | Roche et al. | |
| 7,213,405 | B2 * | 5/2007 | Shapiro | 62/228.3 |
| 2003/0010046 | A1 | 1/2003 | Freund et al. | |
| 2003/0213256 | A1 | 11/2003 | Ueda et al. | |
| 2004/0123605 | A1 | 7/2004 | Pruitt et al. | |
| 2004/0163403 | A1 | 8/2004 | Monfarad | |
| 2005/0098162 | A1 | 5/2005 | Bryant | |
| 2006/0171825 | A1 | 8/2006 | Choi et al. | |
| 2006/0201171 | A1 * | 9/2006 | Unger et al. | 62/175 |

FOREIGN PATENT DOCUMENTS

| | | | |
|---|---|---|---|
| DE | 20307327 | U | 9/2004 |
| EP | 0106414 | A2 | 4/1984 |
| EP | 0161429 | | 11/1985 |
| EP | 0935106 | A2 | 8/1999 |
| EP | 1347251 | | 9/2003 |
| JP | 54042058 | | 4/1979 |
| JP | 03267592 | | 11/1991 |
| JP | 11-337198 | | 12/1999 |
| JP | 2004278824 | | 10/2004 |
| WO | 00/79671 | A1 | 12/2000 |

OTHER PUBLICATIONS

Reuven Z. Unger, Linear Compressors for Clean and Specialty Gases, 1998 International Compressor Engineering Conference, Purdue University, Jul. 14-17, 1998.

Carlyle Compressor Div., Carrier Corporation, Compound Cooling Compressor Application Guide, Apr. 1994, Lit No. 574-066, Syracuse, NY.

Huff, Hans-Joachim, Options For A Two-stage Transcritical Carbon Dioxide Cycle, IIR Gustav Lorentzen conference on natural working fluids. Joint conference of the International Institute of Refrigeration section B and E, XX, XX, Sep. 17, 2002, pp. 158-164.

European Search Report dated Jan. 18, 2008.

* cited by examiner

TWO-STAGE LINEAR COMPRESSOR

BACKGROUND

The present invention relates to a refrigeration system including a two-stage linear compressor with dual-opposed pistons, and more particularly to a control system for operating the linear compressor in an economizer cycle.

In refrigeration systems, such as those used in cooling display cases of refrigeration merchandisers, it is necessary to maintain a constant temperature in the display cases to ensure the quality and condition of the stored commodity. Many factors demand varying the cooling loads on evaporators cooling the display cases. Therefore, selective operation of the compressor of the refrigeration system at different cooling capacities corresponds to the cooling demand of the evaporators. In refrigeration systems utilizing existing scroll and screw compressors, an economizer cycle is used to increase the refrigeration capacity and improve efficiency of the refrigeration system. In the economizer cycle of existing scroll and screw compressors, gas pockets in the compressor create a second "piston" as mechanical elements of the compressor proceed through the compression process.

Further, scroll compressors use oil for operation, which results in inefficient performance due to oil film on evaporator and condenser surfaces, requires the use of expensive oil management components, and increases the installation cost of the refrigeration system. Scroll compressors are operable with an economizer, however, efficiency is compromised because the volume ratio is fixed. Some refrigeration systems utilize a linear compressor, which provides variable capacity control of the refrigeration system.

SUMMARY

In one embodiment, the invention provides a control system for managing operation of a dual-piston linear compressor with an economizer cycle wherein a first piston operates as a first stage of the economizer cycle and a second piston operates as a second stage of the economizer cycle. The control system includes a controller coupled to the linear compressor to control a volume flow ratio of the linear compressor. A first sensor for measuring a first operating condition of the linear compressor is coupled to the controller and the first operating condition corresponds to a suction pressure of the linear compressor. A second sensor for measuring a second operating condition of the linear compressor is coupled to the controller and the second operating condition corresponds to a discharge pressure of the linear compressor. A third sensor for measuring a third operating condition of the linear compressor is coupled to the controller and the third operating condition corresponds to an intermediate pressure of the linear compressor. Based upon the first operating condition measured by the first sensor, the second operating condition measured by the second sensor, and the third operating condition measured by the third sensor, the controller varies operation of at least one of the first and second pistons until the intermediate pressure is substantially equal to a pressure required for most efficient operation of the linear compressor.

In another embodiment, the invention provides a control system for managing operation of a dual-piston linear compressor with an economizer cycle wherein a first piston operates as a first stage of the economizer cycle and a second piston operates as a second stage of the economizer cycle. The control system includes a controller coupled to the linear compressor to control a volume flow ratio in the linear compressor, a first sensor for measuring a first operating condition of the linear compressor, and a second sensor for measuring a second operating condition of the linear compressor. The first sensor is coupled to the controller and the first operating condition corresponds to a suction pressure of the linear compressor, and the second pressure sensor is coupled to the controller and the second operating condition corresponds to a discharge pressure of the linear compressor. The controller measures piston stroke of the first piston and piston stroke of the second piston. Based upon the first operating condition measured by the first sensor, the second operating condition measured by the second sensor, and the piston stroke of at least one of the first and second pistons, the controller varies operation of at least one of the first and second pistons until the volume flow ratio is at a point of maximum efficiency.

In yet another embodiment, the invention provides a refrigeration system including a two-stage linear compressor having a first piston disposed in a first cylinder and a second piston disposed in a second cylinder. The linear compressor is operable in an economizer cycle wherein the first piston operates as a first stage of the economizer cycle and the second piston operates as a second stage of the economizer cycle. A controller is coupled to the linear compressor to control a volume flow ratio in the linear compressor. The controller stores a plurality of coefficients of performance for a range of particular operating conditions of the linear compressor, and each coefficient of performance corresponds to a desired volume flow ratio and a desired secondary evaporating temperature. Based upon measured operating conditions of the linear compressor, the controller determines a highest coefficient of performance from the plurality of coefficients of performance and varies operation of at least one of the first and second pistons to achieve the desired volume flow ratio.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

The present invention described with respect to FIGS. 1-6 relates to a control system for operating a two stage linear compressor with dual-opposed pistons in an economizer cycle. The control system controls operation of either or both of a primary piston and a secondary piston of the linear compressor such that a secondary evaporating temperature of the refrigeration system and a volume flow ratio of the linear compressor operate at a point of highest efficiency for the refrigeration system. Generally, the control system varies piston stroke or piston frequency of the primary piston and/or the secondary piston.

Figure 1:
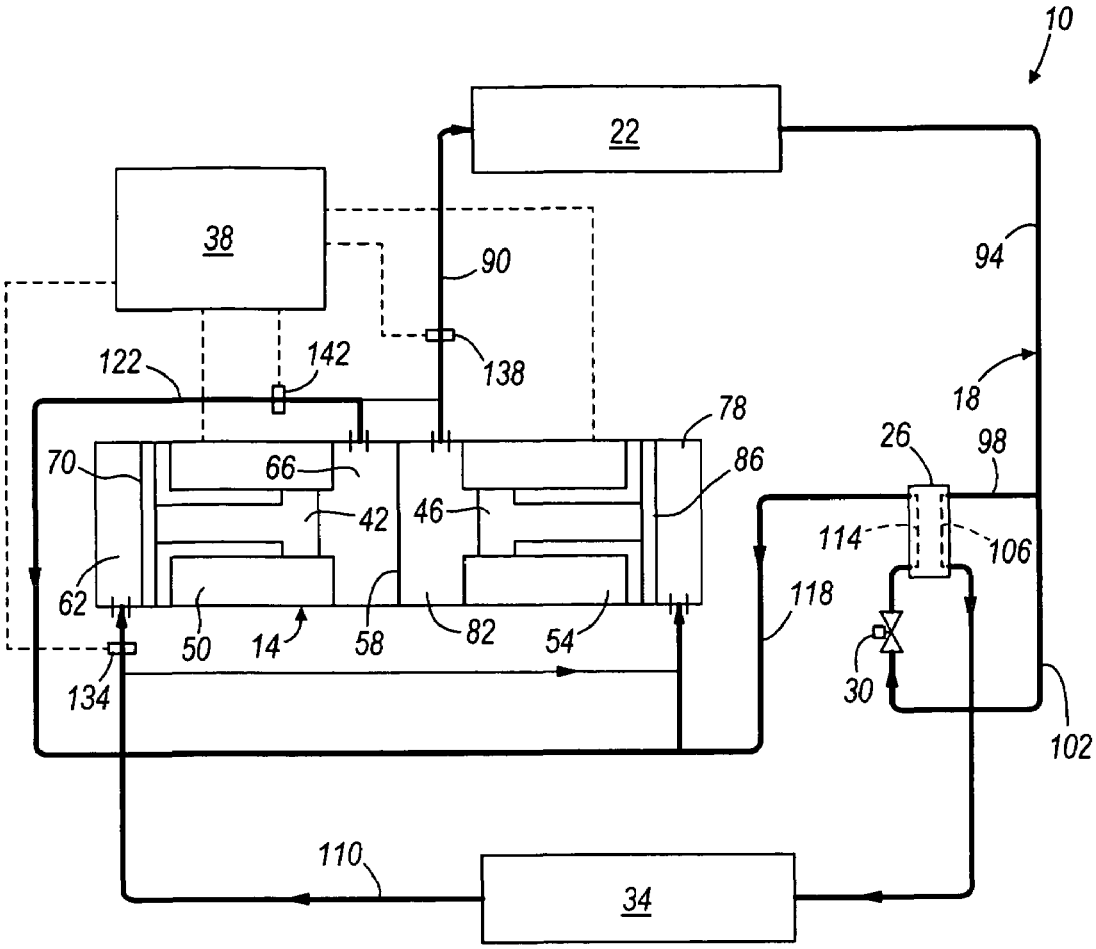
FIG. 1 is a schematic diagram of a refrigeration system including a two-stage linear compressor with dual-opposed pistons embodying the present invention.

FIG. 1 is a schematic diagram of a refrigeration system 10 including a two-stage linear compressor 14 with dual-opposed pistons. In FIG. 1 the linear compressor 14 is shown in an economizer cycle in which refrigerant flows through the refrigeration system along an economizer gas flow path 18 (shown as a bold, solid line in FIG. 1). In the illustrated embodiment, components of the refrigeration system 10 include the linear compressor 14, a condenser 22, an economizer 26 (or liquid subcooler), an expansion device 30 (typically referred to as the expansion valve), and an evaporator 34, all of which are in fluid communication. In a further embodiment, the refrigeration system 10 includes other components, such as a receiver, a filter, etc.

The refrigeration system 10 includes a controller 38 for controlling operation of the linear compressor 14. The controller 38 is operable to switch the linear compressor 14 between the economizer cycle (shown in FIG. 1) and a single stage cycle (shown in FIG. 2), and to control operation of a primary piston 42 and a secondary piston 46 of the linear compressor 14. In a further embodiment, one controller operates the linear compressor 14 and another controller operates to switch the linear compressor 14 between the economizer cycle and the single stage cycle.

Figure 2:
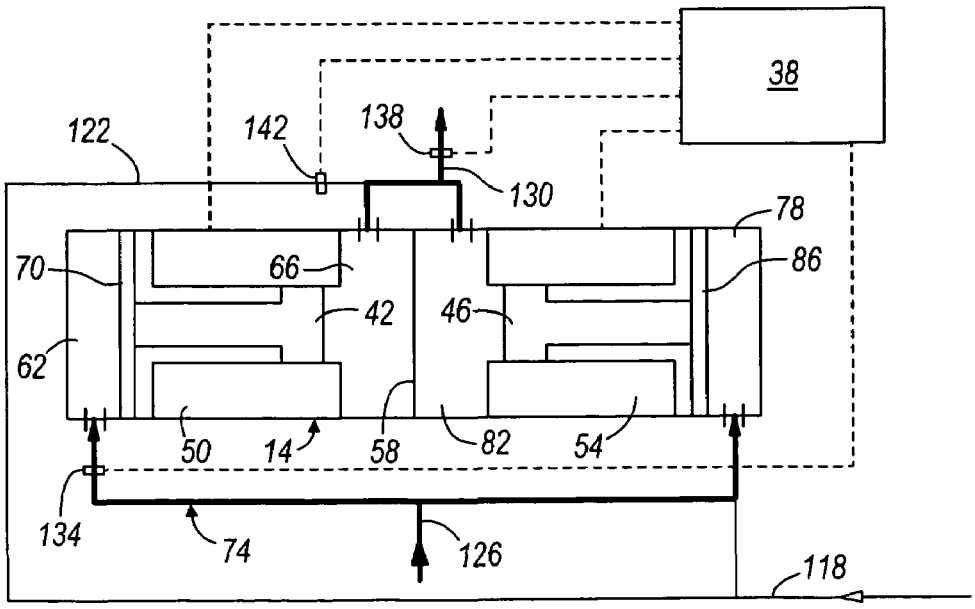
FIG. 2 is a schematic diagram of the two-stage linear compressor operating in a single stage cycle.

A schematic of the dual-opposed piston linear compressor 14 is shown in FIGS. 1 and 2. The linear compressor 14 includes a first cylinder 50 and a second cylinder 54 separated by a dividing wall 58. The primary piston 42 is disposed in the first cylinder 50 and divides the first cylinder 50 into a suction chamber 62 and a discharge chamber 66. The primary piston 42 is secured to a spring 70. Refrigerant enters the suction chamber 62 of the first cylinder 50 from a refrigerant flow path and is discharged from the discharge chamber 66 of the first cylinder 50 to a refrigerant flow path (e.g, the economizer gas flow path 18 shown in FIG. 1 or a single stage gas flow path 74 shown by a bold, solid line in FIG. 2).

The secondary, or economizer, piston 46 is disposed in the second cylinder 54 and divides the second cylinder 54 into a suction chamber 78 and a discharge chamber 82. The secondary piston 46 is secured to a spring 86. The primary and secondary pistons 42, 46 are opposed and each piston moves back and forth in its respective cylinder in generally opposite directions of movement. Refrigerant enters the suction chamber 78 of the second cylinder 54 from a refrigerant flow path and is discharged from the discharge chamber 82 of the second cylinder 54 to a refrigerant flow path (e.g, the economizer gas flow path 18 shown in FIG. 1 or the single stage gas flow path 74 shown in FIG. 2). The controller 38 controls piston stroke and displacement or piston frequency (e.g., strokes per second) of the primary and secondary pistons 42, 46 within the first and second cylinders 50, 54. A linear motor (shown in FIG. 3) for each piston is coupled to the controller 38 and responsive to control signals from the controller 38 to operate the primary and secondary pistons 42, 46.

In general, compressed refrigerant discharged from the linear compressor 14 travels to the condenser 22 through a condenser line 90. After leaving the condenser 22, the refrigerant next travels to the economizer 26 located upstream of the evaporator 34 through a refrigerant line 94 that divides into a first line 98 and a second line 102. Refrigerant directed to the first line 98 passes through a first side 106 of the economizer 26 by way of a heat exchanger element (not shown) to the evaporator 34. After the refrigerant passes through the evaporator 34, the refrigerant is delivered to the linear compressor 14 through an evaporator line 110. The controller 38 switches the linear compressor 14 between economizer operation and single stage operation, for example by actuating appropriate control valves positioned in the refrigerant flow paths (e.g, the economizer gas flow path 18 shown in FIG. 1 or a single stage gas flow path 74 shown in FIG. 2).

When the linear compressor 14 is in the economizer cycle, a portion of the refrigerant is diverted to travel through the second line 102. The second line 102 is fluidly connected to the expansion valve 30. Refrigerant directed to the second line 102 passes through the expansion valve 30, through a second side 114 of the economizer 26, and out to an economizer line 118. Refrigerant that passes through the second side 114 of the economizer 26 is used to cool refrigerant that passes through the first side 106 of the economizer 26. The economizer line 118 delivers refrigerant to the linear compressor 14. In another embodiment, the refrigerant line 94 divides into a first line and a second line at the outlet of the condenser 22. In yet another embodiment, the refrigerant line 94 divides into a first line and a second line after the refrigerant exits the first side 106 of the economizer 26. The first line directs refrigerant to the evaporator 34 and the second line directs refrigerant through the expansion valve 30 and to the second side 114 of the economizer 26.

In the single stage cycle, refrigerant flows along the single stage gas flow path 74, shown by the bold line in FIG. 2. The linear compressor compresses refrigerant in a single step, whereby the refrigerant is compressed by the primary and secondary pistons 42, 46 with gas flow in parallel. Both the primary piston 42 and the secondary piston 46 share a common suction line 126, which receives refrigerant from the evaporator line 110, and a common discharge line 130, which delivers refrigerant to the condenser line 90.

In the economizer cycle, refrigerant flows along the economizer gas flow path 18, shown by the bold, solid line in FIG. 1. The linear compressor 14 compresses refrigerant in two step process, whereby the refrigerant is compressed first by the primary piston 42 and subsequently by the secondary piston 46. The suction chamber 62 of the primary piston 42 receives refrigerant from the evaporator line 110, and the discharge chamber 66 of the primary piston 42 discharges refrigerant to a discharge line 122 that is fluidly connected to the economizer line 118. The suction chamber 78 of the secondary piston 46 receives refrigerant from the economizer line 118, which includes refrigerant from both the primary piston chamber 66 and the economizer 26, and the discharge chamber 82 of the secondary piston 46 discharges refrigerant to the condenser line 90.

In the economizer cycle, the suction chamber 62 of the primary piston 42 receives cool refrigerant through the evaporator line 110 and the primary piston 42 compresses the refrigerant, which increases the temperature and pressure of the refrigerant. The compressed refrigerant is discharged from the discharge chamber 66 of the primary piston 42 as a warm-temperature, medium-pressure heated gas to the discharge line 122. Low-temperature, medium-pressure vapor refrigerant from the economizer 26 is mixed with the discharged gas from the primary piston chamber 66 in the economizer line 118. The mixed refrigerant enters the suction chamber 78 of the secondary piston 46 from the economizer line 118. Mixing the refrigerant from the primary piston chamber 66 with the refrigerant from the economizer 26 lowers the temperature of the refrigerant entering the secondary piston suction chamber 78, which prevents overheating of the linear compressor. The secondary piston 46 compresses the mixed refrigerant, which increases the temperature and pressure of the refrigerant. The compressed refrigerant is discharged from the discharge chamber 82 of the secondary piston 46 as a high-temperature, high-pressure heated gas to the condenser line 90.

The refrigerant travels to the condenser 22 and the condenser 22 changes the refrigerant from a high-temperature gas to a warm-temperature liquid. The high-pressure liquid refrigerant then travels to the economizer 26 through the refrigerant line 94. A portion of the refrigerant is directed to the first line 98 through the first side 106 of the economizer 22 and the remaining refrigerant is directed to the second line 102 through the second side 114 of the economizer 26. In one embodiment, a control valve is used to divert refrigerant from the refrigerant line 94 to the second line 102.

The warm-temperature, high-pressure liquid refrigerant passes through the heat exchanger (i.e., economizer) on the first side 106 and is cooled further to a cool-temperature liquid refrigerant. Warm-temperature, high-pressure liquid refrigerant from the second line 102 passes through the expansion valve 30, which creates a pressure drop between the second refrigerant line 102 upstream and downstream of the expansion valve 30. Low-temperature, medium-pressure refrigerant exits the expansion valve 30 and passes through the second side 114 of the economizer 26, which cools the refrigerant passing through the first side 106 of the economizer 26.

In the illustrated embodiment, the expansion valve 30 is a thermal expansion valve controlled by pressure and temperature at the outlet of the heat exchanger, i.e., the temperature and pressure in the economizer line 118. In a further embodiment, the expansion valve 30 is an electronic valve controlled by the controller 38, or a separate, independent controller (not shown) based upon measured interstage and/or discharge temperature.

The refrigerant from the first side 106 of the economizer 26 enters the evaporator 34 and cools commodities stored in the environmental spaces (not shown). After leaving the evaporator 34, the cool refrigerant re-enters the suction chamber 62 of the primary piston 42 to be pressurized again and the cycle repeats. The refrigerant from the second side 114 of the economizer 26 enters the economizer line 118 to be mixed with the gas discharged from the discharge chamber 66 of the primary piston 42. The mixed refrigerant enters the suction chamber 78 of the secondary piston 46 from the economizer line 118 to be pressurized again.

In the economizer cycle, operation of the primary and secondary pistons 42, 46 is controlled to maintain operation of the linear compressor 14 at a point of best energy efficiency. In particular, the controller 38 controls piston stroke or piston frequency of one or both of the primary and secondary pistons 42, 46 to maintain a secondary evaporating temperature and a volume flow ratio (i.e., the ratio between the primary piston displacement and the secondary piston displacement) of the linear compressor at values corresponding to a highest efficiency of the refrigeration system 10. Although the controller 38 controls operation of the linear compressor 14 by either varying piston stroke or varying piston frequency of one or both of the primary and secondary pistons, other known means for controlling operation of the linear compressor to maintain a secondary evaporating temperature and a volume flow ratio may be used.

In one embodiment of the present invention, the controller 38 manages operation of the linear compressor 14 based upon a suction pressure, a discharge pressure, and an intermediate pressure of the linear compressor. As shown in FIG. 1, the control system includes a first pressure sensor 134, a second pressure sensor 138, and a third pressure sensor 142. The first pressure sensor 134 is disposed in the evaporator line 118 adjacent the linear compressor 14 for measuring a primary suction pressure of the linear compressor 14. The second pressure sensor 138 is disposed in the condenser line 90 adjacent the linear compressor 14 for measuring discharge pressure of the linear compressor 14. The third pressure sensor 142 is disposed in the discharge line 122 of the primary piston chamber 66 for measuring intermediate pressure of the linear compressor 14. All of the sensors 134, 138, 142 are coupled to the controller 38 for transmitting the measured pressures to the controller 38.

In operation, pressure measurements from the first, second, and third pressure sensors 134, 138, 142 are transmitted to the controller 38. The controller 38 stores a plurality of coefficient of performance values (COP) for a range of particular operating conditions of the refrigeration system 10, in particular an evaporating temperature of the refrigeration system 10 and a condensing temperature of the refrigeration system 10. The controller 38 derives the evaporating temperature based upon the measured suction pressure and derives the condensing temperature based upon the measured discharge pressure. Based upon the derived evaporating temperature and condensing temperature of the refrigeration system 10, the controller 38 calculates a COP relating to highest efficiency operation of the linear compressor 14 and the refrigeration system 10 for the specific operating conditions.

The COP cooresponds to a desired secondary evaporating temperature, which corresponds to a desired intermediate pressure, and a desired volume flow ratio for the linear compressor 14. The controller 38 varies operation of either or both of the primary piston 42 and the secondary piston 46 until the measured intermediate pressure is substantially equal to the desired intermediate pressure needed for highest efficiency of the refrigeration system 10. For example, if piston stroke of the secondary piston 46 is decreased, the volume flow ratio will increase and the secondary evaporating temperature will increase.

In another embodiment of the control system described above, the first, second and third pressure sensors 134, 138, 142 are replaced with sensors that measure other operating conditions of the refrigeration system. For example, a first sensor measures the evaporating temperature of the refrigeration system 10 in the evaporator line 110, a second sensor measures the condensing temperature of the refrigeration system 10 in the condensing line 90, and a third sensor measures the secondary evaporating temperature of the refrigeration system 10 in the discharge line 122 from the primary piston chamber 66.

In another embodiment of the present invention, the controller 38 manages operation of the linear compressor 14 based upon a suction pressure of the linear compressor 14, a discharge pressure of the linear compressor 14, and piston stroke of one or both of the primary and secondary pistons 42, 46. The control system includes the first pressure sensor 134 disposed in the evaporator line 110 for measuring the suction pressure of the linear compressor 14, the second pressure sensor 138 disposed in the condenser line 90 for measuring discharge pressure of the linear compressor 14, and linear motors (shown in FIG. 3) of the linear compressor 14. In this embodiment, the third pressure sensor 142 for measuring intermediate pressure is not necessary.

In operation, pressure measurements from the first and second pressure sensors 134, 138 are transmitted to the controller 38 and the controller 38 measures piston stroke of the primary piston 42 and the secondary piston 46. As discussed above, the volume flow ratio corresponds to a ratio between piston stroke of the primary piston 42 and piston stroke of the secondary piston 46 (i.e., the ratio between the primary piston displacement and the secondary piston displacement). In one embodiment, the controller 38 infers piston stroke of the primary piston 42 based upon back EMF from the linear motor associated with the primary piston 42, and the controller 38 infers piston stroke of the secondary piston 46 based upon back EMF from the linear motor associated with the secondary piston 46.

The controller 38 stores a plurality of COP values for a range of particular operating conditions of the refrigeration system 10, in particular the evaporating temperature of the refrigeration system 10 and the condensing temperature of the refrigeration system 10. The controller 38 derives the evaporating temperature based upon the measured suction pressure and derives the condensing temperature based upon the measured discharge pressure. Based upon the derived evaporating and condensing temperatures of the refrigeration system 10, the controller 38 calculates a COP relating to highest efficiency operation of the linear compressor 14 and the refrigeration system 10 for the specific operating conditions.

In addition to corresponding to a desired secondary evaporating temperature, each COP corresponds to a desired volume flow ratio for the linear compressor 14. The controller 38 varies operation (e.g., piston stroke or piston frequency) of either or both of the primary piston 42 and the secondary piston 46 until the measured volume flow ratio is substantially equal to the desired volume flow ratio needed for highest efficiency of the linear compressor 14.

In another embodiment of the control system described above, the first and second pressure sensors 134, 138 are replaced with sensors that measure other operating conditions of the refrigeration system 10. For example, a first sensor measures the evaporating temperature of the refrigeration system in the evaporator line 110 and a second sensor measures the condensing temperature of the refrigeration system in the condensing line 90.

Figure 3:
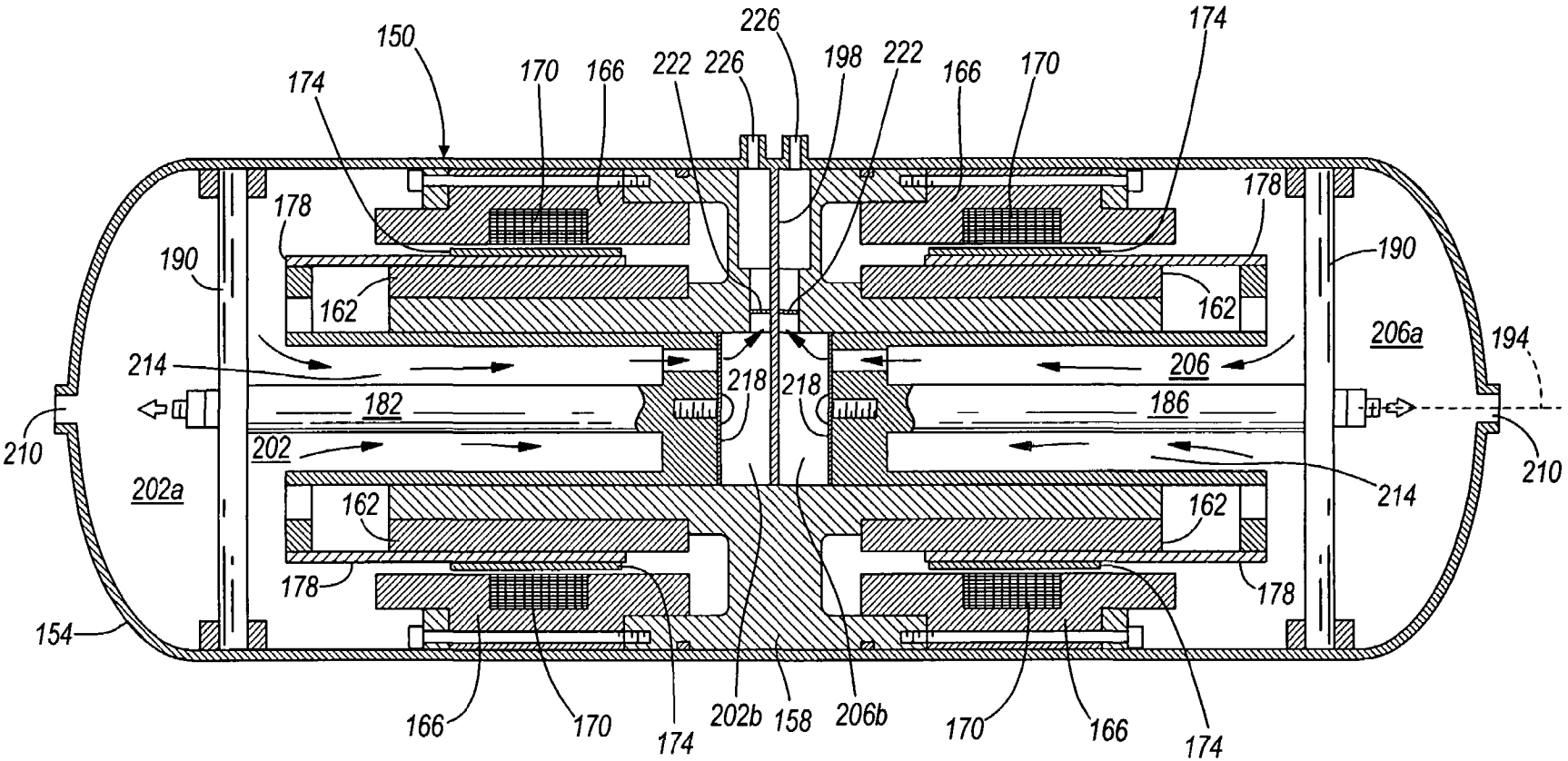
FIG. 3 is a sectional view of a dual opposing, free-piston linear compressor used in the refrigeration system of FIG. 1.

One embodiment of a dual-opposed piston linear compressor 150 is shown in FIG. 3 at an intake stroke. The dual-opposed piston linear compressor 150 includes a housing 154 supporting a main body block 158. Inner and outer laminations 162 and 166 are secured to the main body block 158 and coils 170 are wound on the outer laminations 166, thereby resulting in stators. The stators, when energized, interact with magnet rings 174 mounted on outer cylinders 178. The outer cylinders 178 are fastened to a first piston 182 and a second piston 186, which are secured to springs 190. The interaction between the magnet rings 174 and the energized stators results in the outer cylinders 178 moving the pistons 182, 186 linearly along an axis of reciprocation 194. A linear motor for each piston is defined by the stator and the magnet rings 174.

A dividing wall 198 separates the first piston 182 and the second piston 186 into a first chamber 202 and a second chamber 206, respectively. Each chamber includes a suction portion 202*a* and 206*a* and a compression portion 202*b* and 206*b*, or discharge portion. When the first and second pistons 182, 186 are at the intake stroke, refrigerant is allowed to flow from a suction port 210 at the suction portion 202*a*, 206*a* of each chamber 202, 206 through channels 214 to the compression chambers 202*b*, 206*b*. When moving from the intake stroke to a compression stroke, the channels 214 are closed by suction valves 218 and refrigerant is compressed out of the compression chambers 202*b*, 206*b* through discharge valves 222 and discharge ports 226.

The linear motor allows for variable compression by the pistons 182, 186, and therefore, the linear compressor 150 provides variable capacity control. In other words, the linear motors can cause the pistons 182, 186 to move a small stroke for a first volume, or to move a larger stroke for a second, larger volume.

In a further embodiment of the linear compressor 14, the primary piston 42 has a larger displacement than the secondary piston 46 to increase the compression ratio of the linear compressor 14 and increase the density of the refrigerant discharged from the linear compressor 14. For example, the primary piston 42 has a larger diameter than the secondary piston 46 or the primary piston 42 has a longer piston stroke than the secondary piston 46. In one embodiment, piston stroke of the primary and secondary pistons 42, 46 is adjusted by the controller 38, and in another embodiment piston frequency of the primary and secondary pistons 42, 46 are adjusted by the controller 38.

Figure 4:
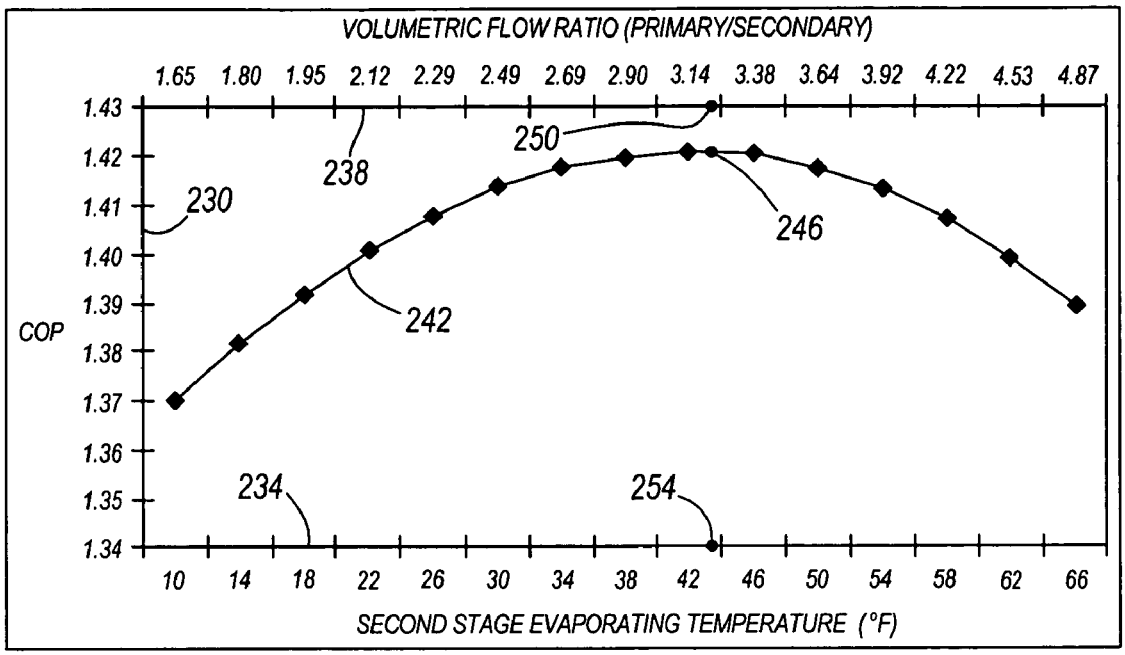
FIG. 4 is a chart showing a coefficient of performance (COP) versus secondary evaporating temperature for the refrigeration system and volumetric flow ratio for the linear compressor.
Figure 5:
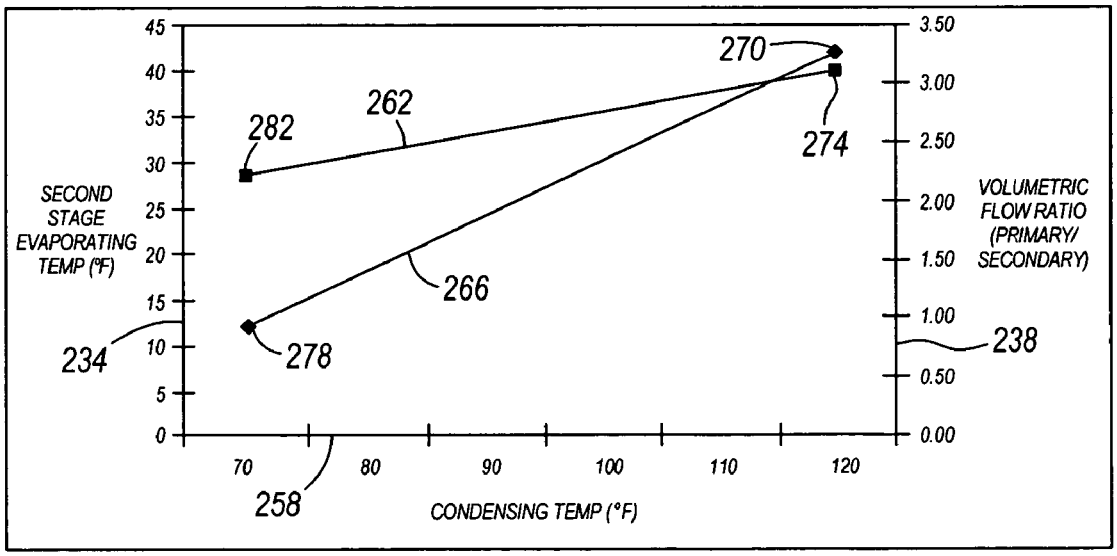
FIG. 5 is a chart showing the volumetric flow rate and secondary evaporating temperature required to maximize COP at a primary evaporating temperature of −40° F.
Figure 6:
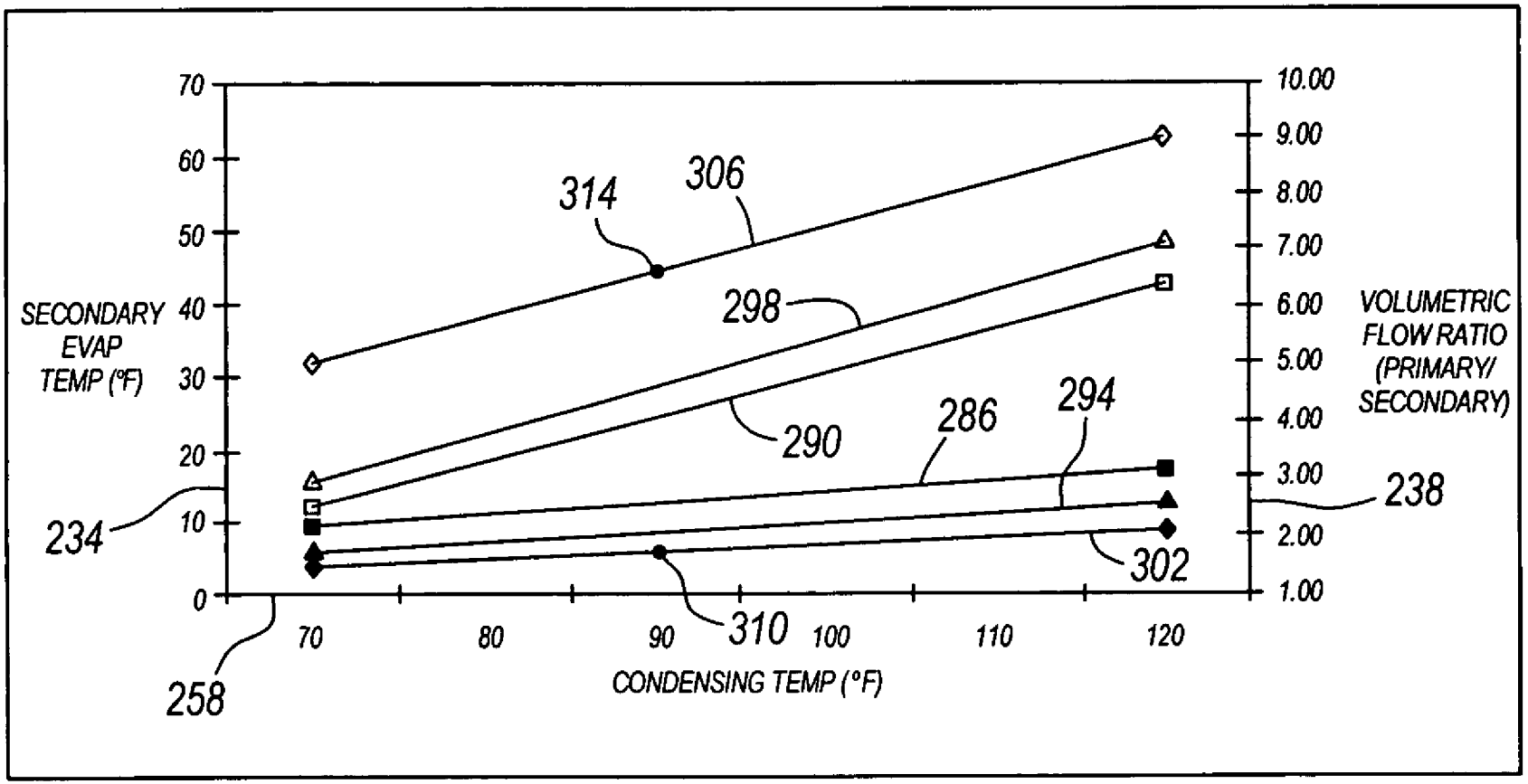
FIG. 6 is a chart showing the volumetric flow rate and secondary evaporating temperature required to maximize COP at various operating conditions.

FIGS. 4-6 are charts illustrating an example of the methodology used by the controller 38 to determine maximum efficient operation of the linear compressor 14 and the refrigeration system 10. The charts illustrated in FIGS. 4-6 reflect the use of R410A refrigerant in the refrigeration system 10, which is a chlorine-free refrigerant. It should be readily apparent that other types of refrigerant may be used in the refrigeration system 10.

FIG. 4 is a chart showing a coefficient of performance (COP) 230 versus secondary evaporating temperature 234 for the refrigeration system 10 and volume flow ratio 238 for the linear compressor 14. FIG. 4 is directed to a specific operating condition of the refrigeration system, −40° F. evaporating temperature and 120° F. condensing temperature. COP 230 relative to the operating condition of the refrigeration system is shown on the Y-axis, and the X-axis has two scales, 1) the secondary evaporating temperature 234 corresponding to a particular COP, and 2) the volume flow ratio 238. As shown in FIG. 4, line 242 represents the COPs for the specific operating condition of the refrigeration system 10 and the COP is highest at point 246 when the volume flow ratio is 3.2 (point 250), which corresponds to a 44° F. secondary evaporating temperature (point 254).

FIG. 4 illustrates that operation of the refrigeration system 10 can be optimized by controlling the secondary evaporating temperature and the volume flow ratio between the primary and secondary pistons 42, 46. As discussed above with respect to the control systems, the refrigeration system 10 controls the secondary evaporating temperature and the volume flow ratio by varying operation of either or both of the primary and secondary pistons 42, 46.

FIG. 5 is a chart showing the volumetric flow rate and secondary evaporating temperature required to maximize COP at a primary evaporating temperature of −40° F. and thereby operate the refrigeration system 10 at highest efficiency. Condensing temperature 258 for the refrigeration system 10 is shown on the X-axis, and the secondary evaporating temperature 234 and the volume flow ratio 238 are shown on the two Y-axes. Line 262 corresponds to the volume flow ratio at −40° F. evaporating temperature and various condensing temperatures, and line 266 corresponds to the secondary evaporating temperature at −40° F. evaporating temperature and various condensing temperatures. Lines 262 and 266 indicate the volume flow ratio and the secondary evaporating temperature needed for highest efficiency. For example, at −40° F. evaporating temperature and 120° F. condensing temperature, the desired secondary evaporating temperature is 44° F. (point 270) and the desired volume flow ratio is 3.2 (point 274) to obtain the highest efficiency (also shown by FIG. 4). As another example, at −40° F. evaporating temperature and 70° F. condensing temperature, the desired secondary evaporating temperature is 12° F. (point 278) and the desired volume flow ratio is 2.2 (point 282) to obtain the highest efficiency. For any condensing temperature at −40° F. evaporating temperature, the highest efficiency secondary evaporating temperature and volume flow ratio can be found by selecting the appropriate points on the graph.

FIG. 6 is a chart showing the volumetric flow rate and secondary evaporating temperature required to maximize COP at other evaporating conditions. The condensing temperature 258 for the refrigeration system is shown on the X-axis, and the secondary evaporating temperature 234 and the volume flow ratio 238 are shown on the two Y-axes. In FIG. 6, line 286 corresponds to the volume flow ratio at −40° F. evaporating temperature, and line 290 corresponds to the secondary evaporating temperature at −40° F. evaporating temperature. Line 294 corresponds to the volume flow ratio at −25° F. evaporating temperature, and line 298 corresponds to the secondary evaporating temperature at −25° F. evaporating temperature. Line 302 corresponds to the volume flow ratio at 0° F. evaporating temperature, and line 306 corresponds to the secondary evaporating temperature at 0° F. evaporating temperature. Accordingly, the most efficient secondary evaporating temperature and volume flow ratio can be found for many operating conditions by locating the appropriate point in FIG. 6. For example, at 0° F. evaporating temperature and 90° F. condensing temperature, the desired volume ratio is 1.6 (point 310) and the desired secondary evaporating temperature is 41° F. (point 314) for highest efficiency operation of the refrigeration system 10.

The controller 38 determines maximum efficient operation of the linear compressor 14 and the refrigeration system 10 using the factors and methodology described above with respect to FIGS. 4-6. The controller 38 stores a plurality of COPs for a variety of operating conditions for the refrigeration system 10. Based upon the factors measured and received by the controller 38, such as suction pressure, discharge pressure, and intermediate pressure (or temperature) or piston stroke of the primary and secondary pistons 42, 46, the controller 38 references a highest COP for the corresponding evaporating temperature and condensing temperature. The COP corresponds to a secondary evaporating temperature and a volume flow ratio for highest efficiency operation of the refrigeration system 10. The controller 38 adjusts piston stroke or piston frequency of either or both of the primary and secondary piston 42, 46 to achieve the desired secondary evaporating temperature and desired volume flow ratio.

Various features and advantages of the invention are set forth in the following claims.

What is claimed is:

1. A control system for managing operation of a dual-piston linear compressor with an economizer cycle wherein a first piston operates as a first stage of the economizer cycle and a second piston operates as a second stage of the economizer cycle, the control system comprising:

a controller coupled to the linear compressor to control a volume flow ratio of the linear compressor and to vary the linear compressor between the economizer cycle having a first gas flow path through the linear compressor and a single stage cycle having a second gas flow path through the linear compressor, the first gas flow path partially defined by the first piston receiving gas from an evaporator line and discharging gas to an economizer line, and further partially defined by the second piston receiving gas from the economizer line and discharging gas to a condenser line such that a suction chamber of the second stage is in fluid communication with a discharge chamber of the first stage;

a first sensor coupled to the controller to measure a first operating condition of the linear compressor including a suction pressure of the linear compressor;

a second sensor coupled to the controller to measure a second operating condition of the linear compressor including a discharge pressure of the linear compressor; and a third sensor coupled to the controller to measure a third operating condition of the linear compressor including an intermediate pressure of the linear compressor, wherein based upon the first operating condition measured by the first sensor, the second operating condition measured by the second sensor, and the third operating condition measured by the third sensor, the controller varies operation of at least one of the first and second pistons until the intermediate pressure is substantially equal to a pressure required for most efficient operation of the linear compressor.

2. The control system of claim 1 wherein the first sensor measures the suction pressure of the linear compressor.

3. The control system of claim 1 wherein the second sensor measures the discharge pressure of the linear compressor.

4. The control system of claim 1 wherein the third sensor measures the intermediate pressure of the linear compressor.

5. The control system of claim 1, wherein the controller calculates a secondary evaporating temperature required for most efficient operation of the linear compressor based upon the suction pressure and the discharge pressure.

6. The control system of claim 5, wherein the controller stores a plurality of coefficients of performance for a range of particular operating conditions of the linear compressor, each coefficient of performance corresponding to a desired intermediate pressure, and further wherein the controller determines a highest coefficient of performance from the plurality of coefficients of performance and varies operation of at least one of the first and second pistons to achieve the desired secondary evaporating temperature.

7. The control system of claim 1, wherein the controller varies operation by adjusting piston stroke for at least one of the first and second pistons.

8. The control system of claim 1, wherein the controller varies operation by adjusting piston frequency for at lest one of the first and second pistons.

9. A control system for managing operation of a dual-piston linear compressor with an economizer cycle wherein a first piston operates as a first stage of the economizer cycle and a second piston operates as a second stage of the economizer cycle, the control system comprising:

a controller coupled to the linear compressor to control a volume flow ratio of the linear compressor and to vary the linear compressor between the economizer cycle having a first gas flow path through the linear compressor and a single stage cycle having a second gas flow path through the linear compressor, the first gas flow path partially defined by the first piston receiving gas from an evaporator line and discharging gas to an economizer line, and further partially defined by the second piston receiving gas from the economizer line and discharging gas to a condenser line such that a suction chamber of the second stage is in fluid communication with a discharge chamber of the first stage;

a first sensor coupled to the controller to measure a first operating condition including a suction pressure of the linear compressor;

a second sensor coupled to the controller to measure a second operating condition including a discharge pressure of the linear compressor; and wherein the controller measures piston stroke of the first piston and piston stroke of the second piston, and further wherein based upon the first operating condition measured by the first sensor, the second operating condition measured by the second sensor, and the piston stroke of at least one of the first and second pistons, the controller varies operation of at least one of the first and second pistons until the volume flow ratio is at a point of maximum efficiency.

10. The control system of claim 9 wherein the first sensor measures the suction pressure.

11. The control system of claim 9 wherein the second sensor measures the discharge pressure.

12. The control system of claim 9 wherein the linear compressor includes a first linear motor for causing displacement of the first piston and a second linear motor for causing displacement of the second piston, and further wherein the controller infers the piston stroke of at least one of the first and second pistons based upon back EMF from the linear motor associated with the piston.

13. The control system of claim 9 wherein the controller calculates the volume flow ratio required for maximum efficiency based upon the suction pressure, the discharge pressure and the piston stroke of at least one of the first and second pistons.

14. The control system of claim 9, wherein the controller stores a plurality of coefficients of performance for a range of particular operating conditions of the linear compressor, each coefficient of performance corresponding to a desired volume flow ratio, and further wherein the controller determines a highest coefficient of performance from the plurality of coefficients of performance and varies operation of at least one of the first and second pistons to achieve the desired volume flow ratio.

15. The control system of claim 9, wherein the controller varies operation by adjusting piston stroke of at least one of the first and second pistons.

16. The control system of claim 9, wherein the controller varies operation by adjusting piston frequency of at least one of the first and second pistons.

17. A refrigeration system comprising:

a two-stage linear compressor including a first piston disposed in a first cylinder and a second piston disposed in a second cylinder, the linear compressor operable in an economizer cycle wherein the first piston operates as a first stage of the economizer cycle and the second piston operates as a second stage of the economizer cycle;

a controller coupled to the linear compressor to control a volume flow ratio in the linear compressor and to vary the linear compressor between the economizer cycle having a first gas flow path through the linear compressor and a single stage cycle having a second gas flow path through the linear compressor, the first gas flow path partially defined by the first piston receiving gas from an evaporator line and discharging gas to an economizer line, and further partially defined by the second piston receiving gas from the economizer line and discharging gas to a condenser line such that a suction chamber of the second stage is in fluid communication with a discharge chamber of the first stage, wherein the controller stores a plurality of coefficients of performance for a range of particular operating conditions of the linear compressor, each coefficient of performance corresponding to a desired volume flow ratio and a desired secondary evaporating temperature, and further wherein based upon measured operating conditions of the linear compressor the controller determines a highest coefficient of performance from the plurality of coefficients of performance and varies operation of at least one of the first and second pistons to achieve either the desired volume flow ratio or the desired secondary evaporating temperature.

18. The refrigeration system of claim 17 wherein the controller varies operation of at least one of the first and second pistons based upon a suction pressure and a discharge pressure.

19. The refrigeration system of claim 18 wherein the controller varies operation of at least one of the first and second pistons until a measured intermediate pressure is substantially equal to an intermediate pressure corresponding to the desired secondary evaporating temperature.

20. The refrigeration system of claim 17 wherein the controller varies operation of at least one of the first and second pistons based upon a suction pressure, a discharge pressure, and a measured piston stroke of at least one of the first and second pistons.

21. The refrigeration system of claim 20 wherein the linear compressor includes a first linear motor for causing displacement of the first piston and a second linear motor for causing displacement of the second piston, and further wherein the measured piston stroke is inferred from back EMF of the linear motor of the at least one piston.

22. The refrigeration system of claim 17, and further comprising:

a first pressure sensor for measuring suction pressure of the linear compressor; and a second pressure sensor for measuring discharge pressure of the linear compressor, wherein the first pressure sensor and the second pressure sensor are electrically connected to the controller.

23. The refrigeration system of claim 22 wherein the controller is operable to measure piston stroke of the first piston and piston stroke of the second piston.

24. The refrigeration system of claim 23 wherein the controller calculates a volume flow ratio at maximum efficiency based upon suction pressure measured by the first pressure sensor, discharge pressure measured by the second pressure sensor, and the measured piston stroke of at least one of the first and second pistons.

25. The refrigeration system of claim 24 wherein the controller varies operation of at least one of the first and second pistons to achieve the volume flow ratio at maximum efficiency.

26. The refrigeration system of claim 22, and further comprising a third pressure sensor for measuring intermediate pressure of the linear compressor, wherein the third pressure sensor is electrically connected to the controller.

27. The refrigeration system of claim 26 wherein the controller is operable to vary operation of at least one of the first and second pistons based upon suction pressure measured by the first pressure sensor and discharge pressure measured by the second pressure sensor until the measured intermediate pressure is substantially equal to an intermediate pressure needed for maximum efficiency.

28. The refrigeration system of claim 17, wherein the controller varies operation by adjusting piston stroke of at least one of the first and second pistons.

29. The refrigeration system of claim 17, wherein the controller varies operation by adjusting piston frequency of at least one of the first and second pistons.

* * * * *